United States Patent [19]

Blairsdale

[11] 3,958,849

[45] May 25, 1976

[54] ELECTRICAL PLUG

[76] Inventor: Donald A. Blairsdale, 1622 Michael Drive, Pinole, Calif. 94564

[22] Filed: Mar. 4, 1975

[21] Appl. No.: 555,222

Related U.S. Application Data

[63] Continuation of Ser. No. 469,074, May 13, 1974.

[52] U.S. Cl. ..... 339/14 P; 339/195 A

[51] Int. Cl.[2] ..... H01R 3/06

[58] Field of Search ..... 339/14 P, 14 R, 195 A, 339/196 A

[56] References Cited

UNITED STATES PATENTS

| | | | |
|---|---|---|---|
| 2,922,134 | 1/1960 | Elfenbein | 339/195 A |
| 3,440,591 | 4/1969 | Whalen | 339/14 R |
| 3,495,205 | 2/1970 | Ricci | 339/14 P |

*Primary Examiner*—Roy Lake
*Assistant Examiner*—DeWalden W. Jones
*Attorney, Agent, or Firm*—Schapp and Hatch

[57] ABSTRACT

A convertible electrical plug is disclosed in which one of the prongs is a retractable grounding prong. A channel is provided in the plug body to receive the grounding prong. The channel in the plug body is generally parallel to the prongs and extends through the flat front end of the plug body through which the prongs pass. The channel in the plug body also extends through the rear surface of the plug body remote from the flat front end. A conductive metallic channel member is disposed in the channel in the plug body and the grounding prong is disposed within the conductive metallic channel member. The conductive metallic channel member is connected to the ground wire of a three-wire electrical cord in the preferred embodiment. The grounding prong and the conductive channel member are retained in the channel in the plug body by means of a pivot pin which passes through the plug body. The grounding prong is capable of pivoting about the pivot pin into either (a) an active position in which the grounding prong is so disposed as to be engaged with one of the female connectors of a three-wire receptacle whenever the plug is plugged into a three-wire receptacle, or (b) an inactive position in which the grounding prong does not pass through the flat front end of the plug body and thus cannot engage a female connector when the plug is plugged into a three-wire receptacle. The lips of the conductive channel are made to project inwardly so as to resiliently engage the grounding prong in either position, active or inactive, for releasably locking it in either position.

7 Claims, 5 Drawing Figures

ELECTRICAL PLUG

This is a continuation of application Ser. No. 469,074, filed May 13, 1974.

The present invention relates to an electric plug, and more particularly to convertible electrical plugs which can be manually converted from three-prong plugs to two-prong plugs, and vice versa.

BACKGROUND OF THE INVENTION

It is now well known to reduce or eliminate shock hazard by providing electrical tools and appliances with three-wire power cords terminating in three-prong plugs adapted to be plugged into three-wire grounded receptacles.

Such three-prong plugs have two power prongs, which correspond generally in structure and function to the prongs of the plugs used in connection with conventional two-wire electrical systems, and a third or grounding prong adapted to engage the grounded female contacts of three-wire grounded receptacles.

Unfortunately, many electrical receptacles commonly found in homes and other buildings are of the two-wire ungrounded variety, rather than the three-wire grounded variety. That is to say, many electrical receptacles commonly found in use today are not provided with a third female contact and corresponding opening adapted to interfit with the grounding prong of a three-prong plug. Adapters are often used to make it possible to use the three-prong plugs with conventional two-wire receptacles but many times such an adapter cannot be found when needed.

This problem is commonly resolved by cutting off the grounding prong of a three-prong plug, thus making it possible to plug the three-prong plug into a two-wire receptacle, but at the same time "accepting" the attendant shock hazard of an ungrounded system. After being thus mutilated the three-prong plug can still be plugged into a three-wire receptacle, but cannot be used to take advantage of the shock protection offered by the ground connection of the three-wire receptacle.

Another known method of dealing with this problem is to mount the grounding prong of a three-prong plug on a pivot, so that if the grounding prong is not to be used it can easily be swung to an inoperative position. This method is not entirely satisfactory because of the poor electrical conducting properties of the simple type of pivot which is generally used. Further, such pivots are subject to wear and corrosion, and thus the user of a particular tool or appliance equipped with such a pivotable prong plug may be relying upon a faulty ground connection, and thus be unprotected from electrical shock, when he believes he is protected.

These and other difficulties experienced with the prior art devices have been obviated in a novel manner by the present invention.

SUMMARY OF THE INVENTION

It is therefore a principle object of the present invention to provide a three-prong electrical plug which is easily manually convertible for use with two-wire receptacles, substantially instantaneously and without tools.

Another object of the present invention is the provision of a three-prong electrical plug which is easily adapted for use as a two-prong plug without detaching therefrom any parts, which could be lost.

A further object of the present invention is the provision of an electrical plug having a pivotable grounding prong in which the ground connection is made through a pair of relatively large area contacts which are resiliently pressed together, and in which the ground contact is not made solely through a pivot.

Yet another object of the present invention is the provision of a three-prong plug having a pivotable grounding prong which in its inactive position is maintained largely within the body of the plug, and thus does not prevent the insertion of another plug into a closely adjacent two-prong receptacle.

An additional object of the present invention is the provision of a convertible electrical plug having a pivotable grounding electrode, in which the grounding electrode assembly consists of a minimum of parts, all of which parts can be easily fabricated in large volume on standard mass production metal working machinery.

A still further object of the present invention is the provision of a convertible three-prong electrical plug having a pivotable grounding electrode in which the pivotable grounding electrode is positively maintained by resilient means in both its active and its inactive position.

In order to achieve these objects the convertible three-prong electrical plug of the present invention generally comprises a pair of power prongs, a conductive channel member extending generally parallel to said power prongs, pivot means disposed centrally of said channel member, grounding prong means pivotably mounted on said pivot means, and resilient locking means for locking said grounding prong means in said channel member in either one of two positions.

Other objects, features, and advantages of the present invention not specifically set out herein will be apparent from the following description, taken in connection with the accompanying drawings.

DESCRIPTION OF THE PREFERRED EMBODIMENT

Figure 1:
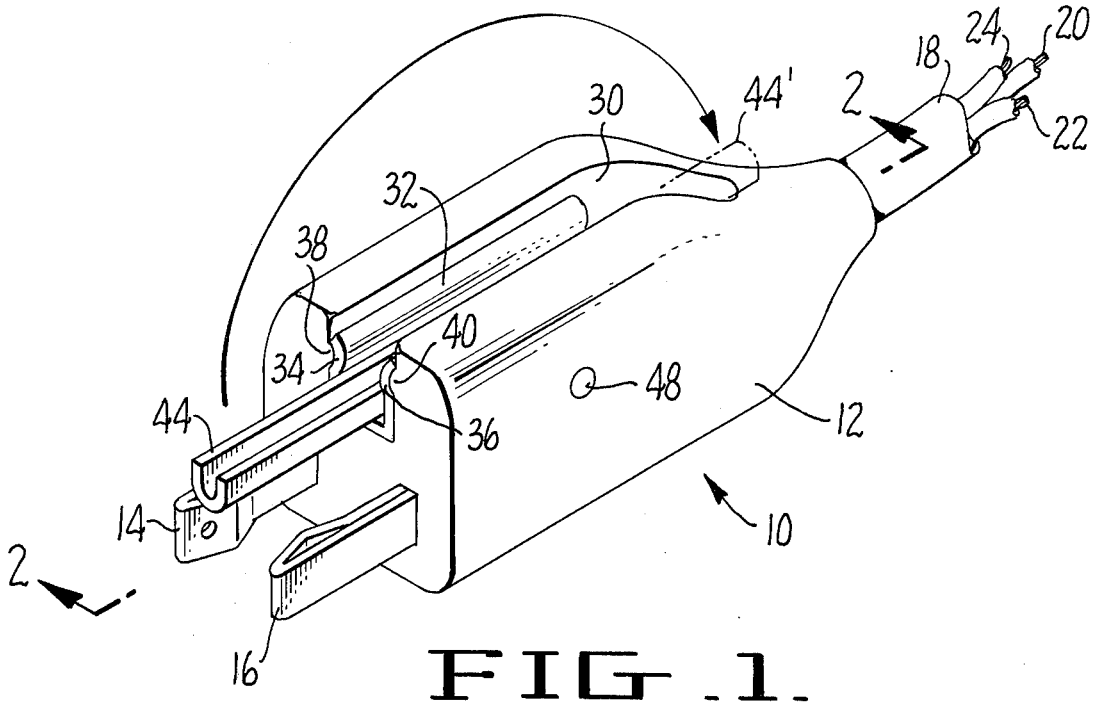
FIG. 1 is a perspective view of the preferred embodiment of the convertible three-prong grounding plug of the present invention, showing the grounding prong in its active position, and indicating the inactive position of the grounding prong in phantom.

Referring first to FIG. 1, wherein the electrical plug of the preferred embodiment is generally indicated by the reference numeral 10, it will be seen that plug 10 comprises a plug body 12, which is preferably fabricated from an insulating material such as rubber or one of the well known equivalent plastic materials. Power prongs 14 and 16 are incorporated in plug body 12 in the well known manner, e.g., by molding. A three-wire power cord 18 is also incorporated into plug body 12, e.g., by molding. Power cord 18 comprises an outer insulating jacket containing three separately insulated wires 20, 22 and 24.

Figure 2:
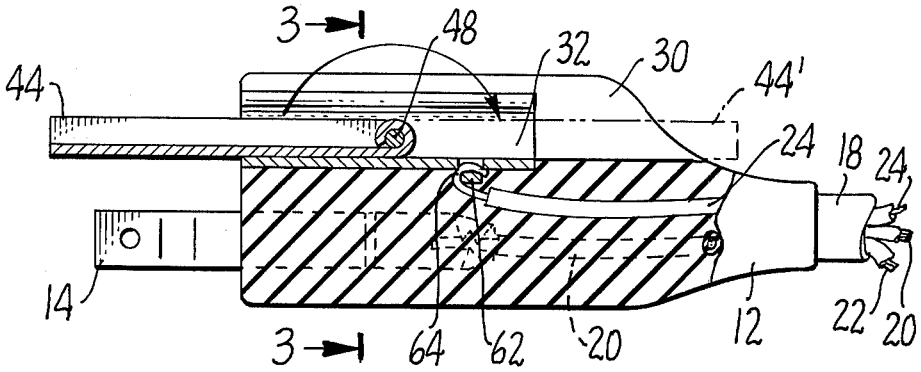
FIG. 2 is an elevational view of the preferred embodiment, partly in section, the plane of the section being indicated by line 2—2 in FIG. 1.

In the well known manner, one of these wires (22) is connected to power prong 16, and another one of these wires (20) is connected to power prong 14. As best seen in FIG. 2, wire 20 is connected to power prong 14 by crimping the inner end of power prong 14 over a bared portion of wire 20. Similarly, power prong 16 is connected to the inner end of wire 22 by crimping the inner end of power prong 16 over a bared portion of wire 22.

Returning to FIG. 1, it will be seen that a channel 30 is provided in the side of plug body 12 remote from power prongs 14 and 16.

Figure 3:
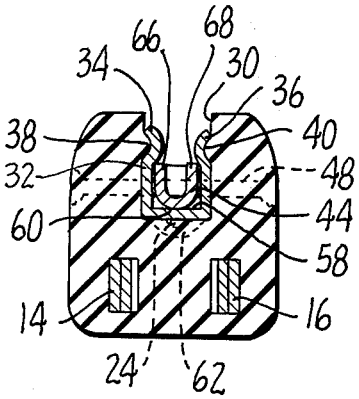
FIG. 3 is a cross-sectional view in elevation of the convertible three-prong plug of FIG. 1, taken on plane 3—3 of FIG. 2.

As may best be seen by comparing FIG. 1 with FIG. 3, a metallic channel member 32 is tight-fittingly disposed in channel 30. In accordance with the preferred embodiment, the inturned portions 34 and 36 of channel member 32 engage ridges 38 and 40 molded into plug body 12, thereby maintaining channel member 32 in position in channel 30 during assembly of the device of the preferred embodiment.

Returning to FIG. 1, and comparing it with FIG. 3, it will be seen that a grounding prong 44 is disposed within channel member 32 in close fitting relation. In particular, going to FIG. 3, it will be seen that the dimensions of grounding prong 44 are so selected with respect to the dimensions of channel member 32 that the inwardly turned portions 34 and 36 of the lips of channel member 32 resiliently press grounding prong 44 downwardly against the bottom of channel member 32, so that a firm, large area contact is maintained between the bottom of grounding prong 44 (as seen in FIG. 3) and the inner bottom face of channel 32 (as seen in FIG. 3) when grounding prong 44 is in its active position.

Figure 4:
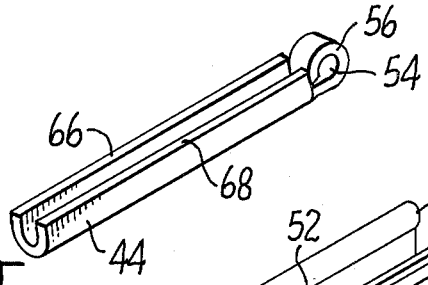
FIG. 4 is a perspective view of the grounding prong of the convertible three-prong grounding plug of FIG. 1.

As may be seen by comparing FIGS. 2 and 3, grounding prong 44 is pivotably maintained within conductive channel member 32 by means of a pivot pin 48. Pivot pin 48 is incorporated into plug body 12, as by molding, and extends continuously from side to side thereof. Within channel 30 pivot pin 48 passes through holes 50, 52 in conductive channel 32 (FIG. 5) and also passes through the passage 54 defined by overturned portion 56 of grounding prong 44 (FIG. 4).

As best seen in FIG. 3, the depth of grounding prong 44 is so selected that when grounding prong 44 is in its active position (shown solid in FIGS. 1 and 2) inwardly turned lips 34 and 36 of conductive channel member 32 firmly urge the bottom of grounding prong 44 against the inner bottom face 58 of conductive channel member 32 over a large contact area 60. As best seen in FIG. 2, conductive channel member 32 is itself connected to ground lead 24 by means of an integral, U-shaped protrusion 62, the bared end 64 of ground lead 24 being interengaged with U-shaped protrusion 62 during assembly, and U-shaped protrusion 62 then being pressed toward its original position to firmly grip bared end 64 and make a low resistance electrical connection therewith. By the novel grounding prong assembly construction just described, grounding prong 44, in its active position, is firmly connected to grounding wire 24 by a low resistance electrical connection which is independent of pivot pin 48. Thus, in accordance with the present invention, a convertible three-prong grounding plug is provided wherein the grounding prong is firmly connected to ground by way of a low resistance electrical connection even after the pivot about which the grounding prong turns from its active to its inactive position has become worn or corroded.

As may further be seen in FIG. 3, electrical contact between grounding prong 44 and conductive channel member 32 is not only made over contact area 60, but is also made between the two outer edges 66, 68 of the upper surface of grounding prong 44 and the inner faces of lips 34 and 36 of conductive channel member 32. In accordance with the teachings of the present invention, outer edges 66 and 68 may be slightly chamferred or rounded in order to maximize the area of these additional contacts between grounding plug 44 and conductive channel member 32. It is recognized as an additional feature of the present invention that the configuration of grounding prong 44 and its coaction with the two other parts of the grounding prong assembly are such that grounding prong 44 need not be fabricated from resilient material, and thus may instead be fabricated from relatively soft conductive material, which under pressure will have a tendency to locally conform to the inner surfaces of inturned lip portions 34 and 36, thus increasing the total area of contact between grounding prong 44 and conductive channel member 32.

OPERATION

As will be evident to those having ordinary skill in the art from FIG. 1 and the present specification, the operation of converting the plug of the preferred embodiment of the present invention from a three-prong plug to a two-prong plug can be accomplished virtually instantaneously, and without the use of tools.

Given, for instance, that grounding prong 44 is in the position shown solid in FIG. 1, and that the user desires to convert the plug of the preferred embodiment of the present invention to a two-prong plug, because only a two-wire receptacle is available, the user need only grasp grounding plug 44 in his fingers, and pull upwardly (as shown in FIG. 1). When so drawn upwardly, grounding prong 44 then turns about the axis of pivot pin 48 until it stands vertically upwardly in conductive channel member 32, being maintained in that position by the inward thrust of the inturned portions 34 and 36 of conductive channel member 32. With grounding prong 44 thus standing in conductive channel member 32, the user merely thrusts grounding prong 44 rearwardly (as shown in FIG. 1), and downwardly, until grounding prong 44, pivoting about the axis of pivot pin 48, assumes the dashed line position 44'. In this position (44') grounding prong 44 is retained by the inwardly turned lip portions 34 and 36 of conductive channel member 32, and, though loosely so maintained, cannot substantially depart from this position even though the plug is inverted with respect to the position shown in FIG. 1.

Assuming, now, that grounding prong 44 is in its dashed (44') position as shown in FIG. 1, and that the user desires to reconvert it to a three-prong plug, this reconversion can be accomplished substantially instantaneously and without tools. As may be seen from FIGS. 1 and 2, a sufficient portion of grounding prong 44 projects rearwardly from channel 30 so that the projecting portion can be easily grasped by the user. The user need merely pull upwardly on this accessible end of grounding prong 44 until grounding prong 44 stands vertical with respect to conductive channel member 32. The reconversion is completed by then pressing grounding prong 44 forward (as seen in FIG. 1) until it assumes the position shown solid in FIG. 1. Grounding prong 44 will then be locked in this active position by the inturned lip portions 34 and 36 of conductive channel member 32, as best seen in FIG. 3, and described hereinabove.

Figure 5:
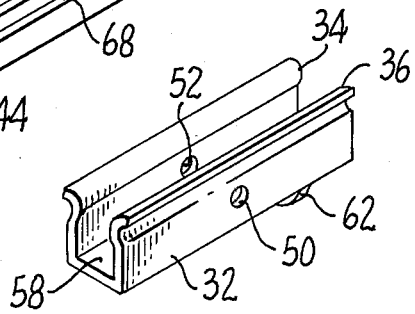
FIG. 5 is a perspective view of the conductive channel member of the convertible three-prong grounding plug of FIG. 1.

Suitable configurations of grounding prong 44 and conductive channel member 32 for carrying out the present invention are shown in FIGS. 4 and 5, respectively. It is to be understood, however, that detailed modifications of these parts may be employed without departing from the spirit and scope of the present invention.

In addition, other modifications may be made in the preferred embodiment shown and described herein without departing from the spirit and scope of the present invention. For instance, it may be desired in some embodiments to provide an ear integral with one of the walls of conductive channel member 32, said ear projecting rearwardly and out of channel 30 (as shown in FIG. 1) sufficiently so that a short electrical "pigtail" lead and spade lug may be attached thereto, whereby ground wire 24 may be grounded, via the spade lug, to the cover plate retaining screw of a two-wire receptacle. Also, other well known means, e.g., tapped holes and coacting screws, mey be employed for connecting the bared ends of wires 20, 22, and 24 to power prongs 14 and 16 and conductive channel member 32. Other obvious modifications of the preferred embodiment falling within the scope of the present invention will occur to those having ordinary skill in the art to which the invention pertains, when informed by the present specification and drawings, and thus all matter contained herein is intended as illustrative only, and not as limiting in scope.

Having thus described my invention, what I claim as new and desired to secure by Letters Patent of the United States is:

1. A convertible electrical plug, comprising:

a plurality of power prongs;

a conductive channel member extending generally parallel to said power prongs and electrically connected to a ground wire;

pivot means disposed within said conductive channel member;

grounding prong means pivotably mounted on said pivot means for pivoting movement from a forwardly pointing active position to a rearwardly pointing inactive position, said grounding prong means being aligned with said conductive channel member in both of said positions; and retaining means for retaining said grounding prong means in either of said two positions and for pressing said grounding prong means against the interior of said conductive channel member to electrically connect said grounding prong means to said ground wire wnen it is in said active position.

2. A convertible electrical plug as claimed in claim 1 in which said retaining means are inturned lip portions of said conductive channel member.

3. A convertible electrical plug as claimed in claim 2 in which said conductive channel member is disposed in a channel formed in a body of elastic insulating material and said elastic insulating material bears against the outer faces of said inturned lip portions when said inturned lip portions are spread, thereby adding to the force with which said inturned lip portions press said grounding prong means against the interior of said conductive channel member.

4. A convertible electrical plug as claimed in claim 3 in which ends of said power prongs and a three-wire power cord containing said ground wire are all molded into said body of elastic insulating material.

5. A convertible electrical plug as claimed in claim 4 in which said pivot means is a pivot pin passing from side to side of said conductive channel member, and said grounding prong means is pivotably mounted on said pivot pin by means of an integral tongue which is disposed around said pivot pin.

6. A grounding prong assembly for a convertible three-wire grounding plug consisting of a conductive channel member, a pivot pin passing through said conductive channel member, and a grounding prong pivotably mounted on said pivot pin, said conductive channel member having inturned lips adapted to maintain said grounding prong in either of the two positions in which said grounding prong is aligned with said conductive channel member, and said conductive channel member being provided with integral connector means for connection to a ground wire.

7. A convertible electrical plug, comprising: an insulating body;

a plurality of power prongs projecting forwardly in spaced parallel relation from said body;

pivot means in said body electrically connected to a ground wire;

grounding prong means pivotally mounted on said pivot means for pivoting movement between a forwardly pointing active position and a rearwardly pointing inactive position with said grounding prong means being in substantially parallel spaced relation to said power prongs in both of said positions; and retaining means in said body formed for releasably holding said grounding prong means in either of said two positions and with said grounding prong means electrically connected to said pivot means when it is in said active position.

* * * * *